US005528722A

United States Patent [19]

Adkins et al.

[11] Patent Number: 5,528,722

[45] Date of Patent: Jun. 18, 1996

[54] ROTATABLE HOUSING FOR SCREEN PLUG IMMERSION HEATER

[75] Inventors: Lorin T. Adkins, Farr West; Reid P. Wiberg, Layton; Barry L. Courtney, North Ogden; Gustav P. Stix, North Ogden; Deborah H. Robinson, North Ogden, all of Utah

[73] Assignee: Emerson Electric Co., St. Louis, Mo.

[21] Appl. No.: 197,251

[22] Filed: Feb. 16, 1994

[51] Int. Cl.[6] ..... F22B 29/06; H05B 3/06

[52] U.S. Cl. ..... 392/497; 219/523

[58] Field of Search ..... 392/501, 497, 392/498, 448, 455; 219/523

[56] References Cited

U.S. PATENT DOCUMENTS

| | | | |
|---|---|---|---|
| 1,742,638 | 1/1930 | Fichtner | 392/501 |
| 2,810,815 | 10/1957 | Dicome | 392/501 |
| 3,450,860 | 1/1969 | Kneisley | 392/501 |
| 4,394,562 | 6/1983 | Epstein et al. | 219/523 |
| 5,191,634 | 3/1993 | Couch | 392/501 |

FOREIGN PATENT DOCUMENTS

| | | | |
|---|---|---|---|
| 0325140 | 2/1930 | United Kingdom | 392/497 |

*Primary Examiner*—Teresa J. Walberg
*Assistant Examiner*—Sam Paik
*Attorney, Agent, or Firm*—Polster, Lieder, Woodruff & Lucchesi

[57] ABSTRACT

A housing (10) for use with an electrical heater (H) mounted on the sidewall (S) of a container (C) for heating a fluid (L) in the container. A heating element (R) is installed in a fitting (F), and the housing facilitates connection of electrical conductors (E) to the heater regardless of its location. A base (12) has an opening in which the fitting is received. The base is positioned against the sidewall when the heater is installed. A cover (36) is sized to fit over the base and attaches thereto. The base has an opening (22) therein through which the electrical conductor is routed for connection to an outer end of the heating element. A ring (26) is used to attach the heater to the base. The baseplate captures the one end of the fitting so the base is freely rotatable with respect thereto. Rotation of the base positions the cover so the conduit opening is readily accessible to an installer thereby to facilitate connection of the conduit to the heating element regardless of the heater location.

7 Claims, 2 Drawing Sheets

ROTATABLE HOUSING FOR SCREEN PLUG IMMERSION HEATER

BACKGROUND OF THE INVENTION

This invention relates to electric heaters such as immersion heaters and, more particularly, to a housing for use with such heaters.

In co-pending U.S. patent application Ser. No. 08/002,183, filed Jan. 8, 1993 and incorporated herein by reference, there is described a heater housing for use with immersion heaters used in water heaters, industrial vats-or tanks, etc. The advantage of the disclosed heater housing occurs because of the out-of-the-way places where a heater may be located. In these locations routing electrical conductors to the heater is often difficult. As described in the co-pending application, the heater housing is rotatable through increments of 60°, for example, to facilitate conductor routing. This provides six possible routing orientations. However, while this housing is a marked improvement over prior housing constructions, which were typically limited to but two positions, there is still a need to provide a housing providing even more flexibility.

SUMMARY OF THE INVENTION

Among the several objects of the present invention may be noted the provision of a housing for use with an immersion heater; the provision of such a housing providing a base for mounting a screwplug assembly including a heating element and a thermostat; the provision of such a housing which is readily rotatable through 360° to facilitate connection of electrical conductors to the screwplug assembly; the provision of such a housing which is particularly useful with screwplug assemblies installed in out-of-the-way, hard to reach places thus to enable quick and easy installation connection and disconnection of the conduit; the provision of such a housing having a cover readily removable for both conduit connection and assembly repair or replacement; the provision of such a housing which provides protection from electrical shock to those working in the vicinity of the heater and who may come into contact with the housing; the provision of such a housing which is available in different sizes for use with different size heater assemblies; and, the provision of such a housing which is a low cost, easy to manufacture it.

In accordance with the invention, generally stated, a housing is for use with an electrical heater that mounts on the sidewall of a container. The heater heats a fluid in the container. A heating element is installed in a fitting, and the housing facilitates connection of an electrical conductor to the heater regardless of its location. A base of the housing has an opening in which the fitting is received. The base is positioned against the sidewall when the heater is installed. A cover of the housing is sized to fit over the base and attaches to the base. The cover has an opening therein through which the electrical conductor is routed for connection to an outer end of the heating element. A ring is used as a platform for the housing base to rotate on. Three (3) screws are used to capture the base under the screw heads and clamp it to the fitting. The base is freely rotatable with respect to the fitting. Rotation of the base positions the cover so the conduit opening is readily accessible to an installer thereby to facilitate connection of the conduit to the heating element regardless of the heater location. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF A PREFERRED EMBODIMENT

Figure 2:
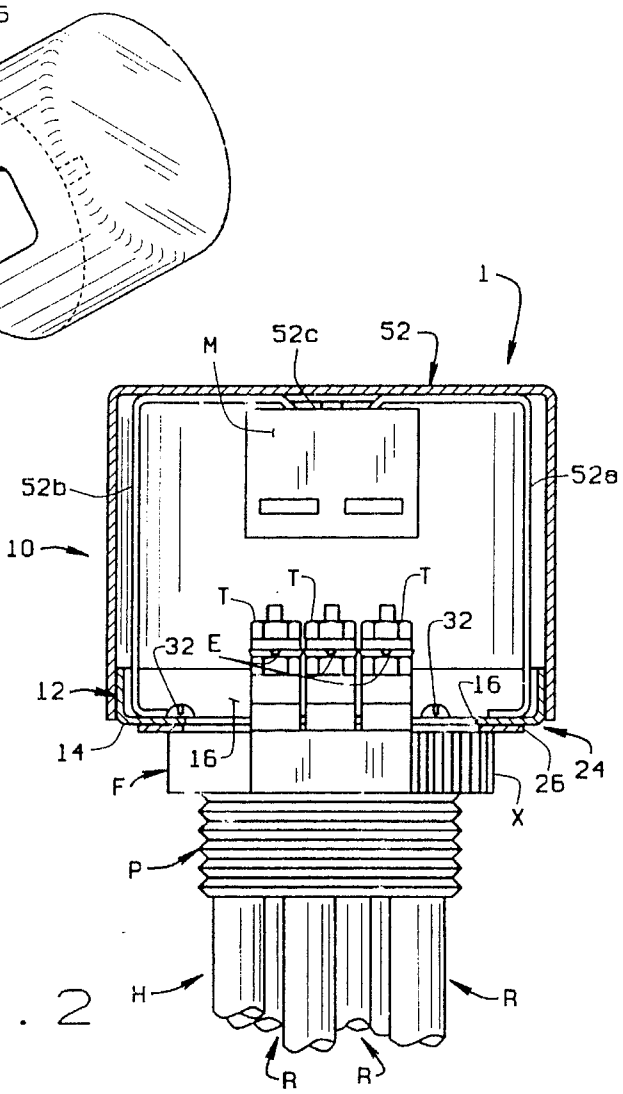
FIG. 2 is a partial sectional view of a heater with the housing installed.

Referring to the drawings, an electric immersion heater I includes a heating element H. The heating element is a generally U-shaped heating rod R (see FIG. 5) with the respective ends of the rods extending through a fitting F. Fitting F comprises a screwplug P having a threaded end which is screwed into a correspondingly threaded opening O in the sidewall S of a container C. The outer ends of the rod project through the outer end of the screwplug. These ends are adapted for connection of electrical conductors E by which electricity is routed to the heating element. The resulting $I^2r$ loss in rod R produces heat used to heat a liquid L stored in the container.

In U.S. patent application Ser. No. 08/002,183 incorporated herein by reference, there is described a heater housing used to facilitate electrical connections to a heater I, especially when the heater is located in difficult to reach locations. As described therein, the housing was rotatable through 60° increments to locate an opening in the housing in the best position for routing electrical conductors to the heating element. While the housing assembly afforded a choice of six positions, as opposed to prior housings which, at most, only afforded two, there are still situations where greater flexibility is advantageous. Housing 10 of the present invention affords that flexibility by allowing the housing to be freely rotated through a full 360° and to be positioned at any desired location.

Figure 3:
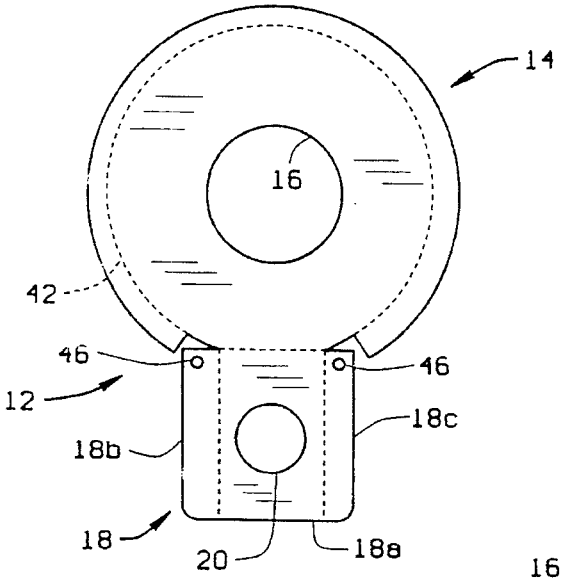
FIG. 3 is a preformed plan view of a base portion of the housing.
Figure 4:
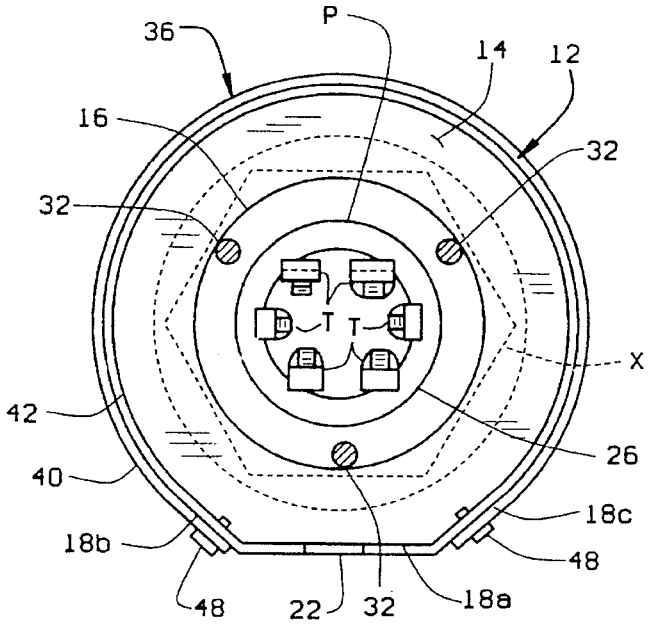
FIG. 4 is a plan view of the interior of the heater with the housing installed; and, FIG. 5 is a sectional view of the heater as installed in place.

Referring to FIG. 3, housing 10 first includes a base 12. The base first includes a circular base plate 14. A concentric opening 16 is formed in the base plate, the diameter of the opening being greater than the diameter of the screwplug. The screwplug, however, has a flange X which, as shown in FIG. 4, is hexagonal shaped. The diameter of flange X is slightly larger than diameter of opening 16. When the heater is to be installed, the screwplug is connected to the housing by placing base plate 14 on top of the flange so opening 16 fits about the inner ends of the heating rods R. A ring 26 fits between the screw plug flange and the base.

When the screwplug is installed in place, electrical terminals T formed on the inner end of rod R are located inside housing 10. Referring to FIG. 4, base 12, in addition to the base plate 14 has an outwardly extending tongue 18. This tongue is generally rectangular in shape, and when the housing is being assembled, the tongue is turned at right angles to the base plate. The tongue then extends upwardly. A circular knock-out 20 is formed in the tongue. This knock-out, when removed leaves an opening 22 for routing the electrical conductors E into the housing. In accordance with the invention, the housing is freely rotatable to align opening 22 with the direction from which the conductors are routed to the heater. This not only greatly simplifies heater installation, but reduces the force on the conductors which otherwise is present if they have to be installed at an angle to their direction of routing.

Housing 10 includes a mounting means 24 for attaching the screwplug to the base. The ring 26, is located on the outside of base plate 14 between the base plate and screw plug flange. The ring has an inner diameter which is smaller than that of opening 16 in base plate 14, but slightly larger than the diameter of the heating element cluster in the screwplug. Further, the outer diameter of the ring is greater than the diameter of opening 16 and the corners of the screwplug flange hex. When ring 26 is installed over the portion of the screwplug extending out through the opening (see FIG. 4), it also covers the gap between the flange and opening sidewall.

Figure 1:
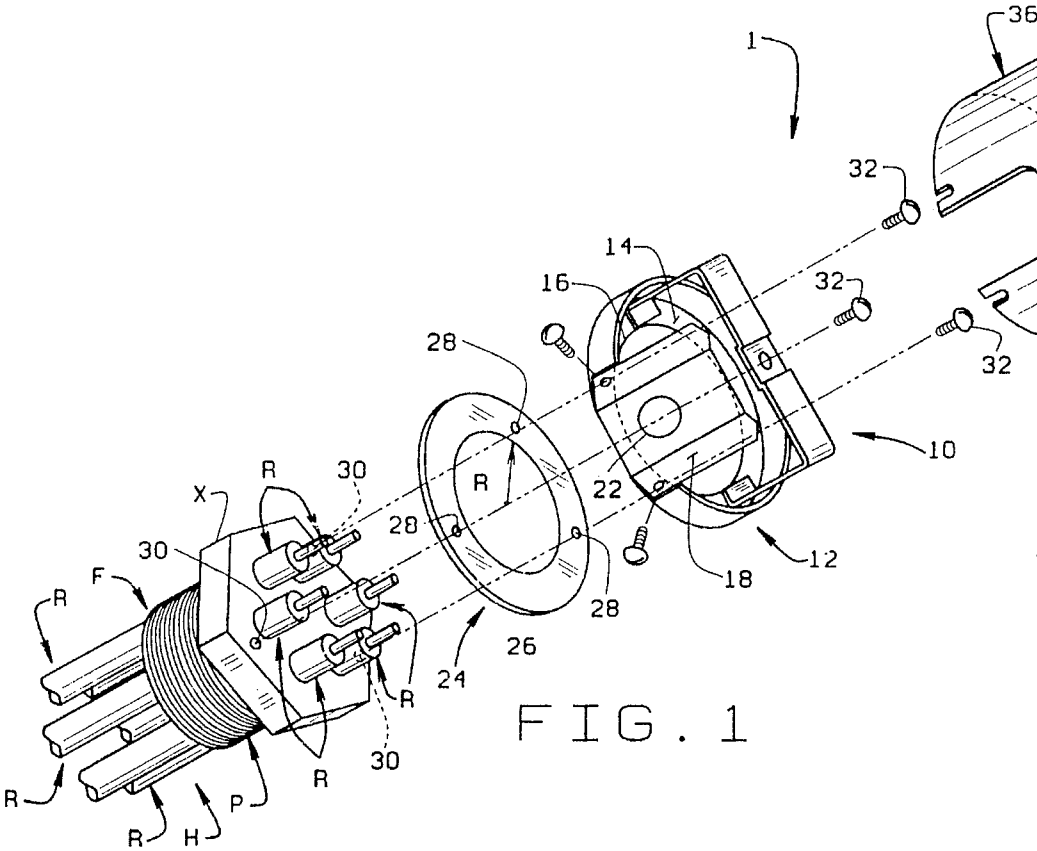
FIG. 1 is an exploded view of a housing of the present invention.

Referring to FIG. 1, ring 26 has three holes 28 equidistantly spaced about its circumference. Each hole is also equidistantly spaced from the center of the ring. The radius R from the center of ring 26 to the holes is such that when the ring is in place, and properly aligned, the holes fit over the gaps between flange X and the sidewall of opening 16. Mounting means 24 further includes fasteners, in the form of screws or bolts 32, for clamping (under the screw heads) the ring and base to the screw plug flange. The fasteners shown in the drawings are, for example, 10–32 type F Phillips head screws. It will be understood, however, that other type screws or bolts could be used. It will further be understood that holes corresponding to those in the ring, are formed in the flange, and would be threaded. In this instance, the ring and flange would all be turned until the respective sets of holes aligned and then the screws 32 would fit through the ring and the screw heads clamp against the base as the screws are tightened into the screwplug flange.

As the screw heads and screw plug flange move toward each other, the screw heads sandwich both flange X of the screwplug, and base plate 14 together. When the screws are sufficiently tightened, the force exerted by the screws locks the ring, screwplug and base plate together. The pieces now effectively form a single unit. However, when the screws are loose, base 12 of the housing can be freely rotated to orient conductor opening 22 in any desired position.

Heater housing 10 next includes a cover 36 which is similar in construction to that described in co-pending patent application Ser. No. 08/002,183. That is, cover 36 is cup or cap shaped having a face plate 38 and a circumferential sidewall 40. As shown in FIG. 4, the outer margin of base plate 14 is formed so that it can be upwardly turned, in the same direction as tongue 18, to form a lip 42 which extends substantially about base 12. The diameter of cover 36 corresponds to that of the base plate, after lip 42 is formed, so the sidewall of cover 36 fits over the lip. The sidewall also has a cutout 44 which is sized to fit over tongue 18 when the cover is set in place. As shown in FIG. 3, tongue 18 has a center section **18*a*, and respective side sections 18*b*, 18*c* on either side of the center section. Sides 18*b*, 18*c*, are folded back from section 18*a* when base 12 is formed, and cutout 44 is sized to fit over section 18*a*. Each side section 18*b*, 18*c* has a threaded hole 46 for receiving a screw 48. Sidewall 40 of cover 36 has keyways 50 formed on either side of cutout 44. The keyways extend upward from the base of the sidewall and are located so the upper end of respective keyways align with the screwholes 46. When the cover is set in place, the screws 48 are threaded into holes 46 through the respective keyways 50**. As the screws are tightened, they press the bottom of the cover sidewall against the lip to complete the heater housing assembly. An advantage of this connection arrangement noted in the co-pending application is that when the cover is removed, the screws do not also have to be removed, only loosened enough to allow the cover to be slipped off. When the cover is subsequently reinstalled, the keyways allow the cover to be easily slid back into place.

To install a heater, the screwplug is first installed on the base using the ring, as above described screwplug is on the inside of the base plate and ring. The screws 32 are inserted through the holes in ring 26. Next, the screws are sufficiently tightened so base plate, ring and screwplug are lightly pulled together. At this time, however, cover 36 is not installed, and base 12 is freely rotatable.

The threaded outer end of the screwplug is threaded into the opening O in sidewall S of the fluid container. When the screwplug is sufficiently threaded into place, the base of housing 10 is rotated until opening 22 in tongue 18 is oriented in the direction from which the electrical conductors E are routed to the heater. When so oriented, the screws 32 are tightened until base plate is locked together with the ring and screwplug. The ends of the electrical conductors are inserted through opening 22 and are attached to terminals T on the ends of heater rod R to electrically connect the heater rod to a power source. When this is done, cover 36 is set in place and tightening of screws 48 lock the cover and base of the housing together. Since the electrical conductors are routed to the heater in the most direct manner, no undue strain is placed on them. This alleviates the need for cable strain relievers or similar strain reducers which may have had to be used previously. Access to the heater only requires loosening screws 48 so the cover can be removed. The screws are left in place, which eliminates the possibility of their being lost.

Figure 5:
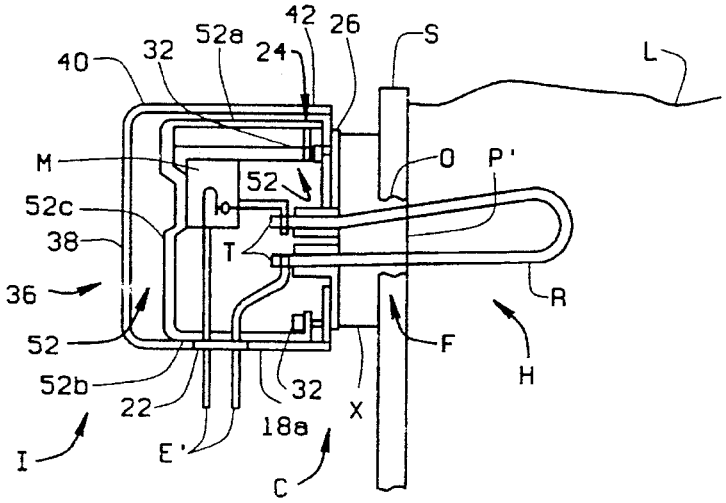

In some applications, it is desirable to install a thermostat M with the heater assembly. As is well-known in the art, one side of the electrical circuit to rod R is routed through the thermostat. If the thermostat senses that the fluid temperature is too high, it breaks the electrical circuit to the rod and subsequently restores it when the fluid temperature falls below a level to which the thermostat is set. In FIGS. 2 and 5, it is seen that thermostat M is located above the inner end of the screwplug (as shown in FIG. 2), or rearwardly of it (as shown in FIG. 5). Cover 36 can be of a height which simply allows it to fit over the inner end of the screwplug, or it can be of a height which accommodates installation of the thermostat.

In FIGS. 2 and 5, a bracket 52 is shown attached to plate 14. Bracket 52 is generally hat-shaped having two base legs **52*a*, 52*b* which abut the inner face of base plate 14 for attachment of the bracket to the base plate, by spot welding for example. The length of these base legs is such that when the outer end of the legs are aligned with the outer margin of the base plate 14, the inner end of the leg, from which a center section 52*c* of the bracket extends upwardly (as shown in FIG. 2), does not meet or contact the outer edge of screwplug flange X. Section 52*b* is sufficiently long so when the thermostat is installed on it, it does not interfere with the electrical terminals protruding inwardly from the inner end of the screwplug. Thermostat M is attached to the bracket in any convenient manner. For example, the case of the thermostat is spot welded to the bracket leg 52*c*, or the case has a pocket in which the bracket leg fits, or the leg has a screw hole (54**) through which a screw is inserted into a corresponding threaded opening in the thermostat.

Installation of the heater when a thermostat is included is essentially the same as previously described. Now, a base plate 14 with bracket 52 and attached thermostat is used. Initial assembly of the ring and screwplug and the orientation of the base to the direction of conductor routing is also as described. Now, when the conductors are inserted through opening 22, one conductor is connected to a terminal T on one end of a rod R, while the other conductor is connected to one side of the thermostat. The other side of the thermostat is then connected to the terminal T on the other end of the rod. Cover 36 is then installed as previously described.

What has been described is a housing for use with an immersion heater. The housing provides a base for mounting a screwplug assembly which includes a heating element and a thermostat. The housing readily rotates through 360° to facilitate connection of electrical conductors to the screwplug assembly, this being particularly useful when screwplug assemblies are installed in out-of-the-way, hard to reach places. A housing cover is readily removable for both conduit connection and assembly repair or replacement, and facilitates quick and easy installation connection and disconnection of a conduit. Further, the housing provides protection from electrical shock to those working in the vicinity of a heater and those who may come into contact with the housing. The housing is available in different sizes for use with different size heater assemblies, and the housing is a low cost, easy to manufacture unit.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A housing for use with a screwplug type heater used to heat a fluid in a container, the screwplug being received in a sidewall of the container and including a heating element for heating the fluid when electrical current is supplied thereto, the housing facilitating the connection of an electrical conductor to the heating element regardless of where the screwplug is installed in the container, the housing comprising:

a ring sized to be positioned over an outer face of the screwplug when the screwplug is installed in the container, respective ends of the heating element extending through the screwplug and extending outwardly from the outer face of the screwplug, the ring having an inner diameter greater than the distance between the ends of the heating element for the ring to fit about the ends of the heating element when positioned in place, and the ring having a plurality of holes therein spaced about the ring and the outer face of the screwplug having a corresponding number of correspondingly positioned holes therein for attaching the ring to the screwplug;

a base having a base plate with a central opening therein the diameter of which is also greater than the distance between the ends of the heating element for the base plate to be installed onto the outer face of the screwplug over the ring, the diameter of the central opening being greater than the inner diameter of the ring, and the base further including a tongue extending at a right angle to the base plate and having an opening therein through which electrical conductors can be routed for connection to the ends of the heating element;

mounting means for attaching the ring to the outer face of the screwplug, said means being insertable through the respective holes in the ring and into the corresponding holes in the outer face of the screwplug, insertion of the mounting means into the holes also serving to clamp the base plate to the ring regardless of the location of the tongue for the base to be freely movable to any convenient position of the tongue to facilitate routing of the electrical conductors for connection to the heating element; and a cover sized to fit over the base for attachment thereto, the cover being installed after electrical connection of the conductors to the outer ends of the heating element to cover the outer face of the screwplug and prevent access to electrical connections, the cover having a faceplate which sits over said base when the cover is in place, and a circumferentially extending sidewall, the sidewall having a cutout therein which is sized to fit over the tongue when the cover is in place.

2. The housing of claim 1 wherein the holes in the ring are equidistantly spaced from the center of the ring, the radius of the opening in the base plate is slightly larger than the radius from a central opening in the ring to each of the holes in the ring for the holes to be uncovered by the base plate when the base is in place, and the mounting means includes screws insertable into the holes in the ring and outer face of the screw plug, the screws each having a screwhead which bears against an inner margin of the base plate when the screws are installed to clamp the base in a desired position.

3. The housing of claim 1 wherein the ring has three holes equidistantly spaced about the ring.

4. The housing of claim 1 wherein the base plate has an upwardly turned circumferentially extending lip at its outer margin, the cover sidewall fitting over the lip to cover the outer face of the screwplug.

5. The housing of claim 4 further including fastening means for attaching the cover to the base.

6. The housing of claim 1 further including means for installing a thermostat within the housing.

7. The housing of claim 6 wherein the thermostat installing means includes a bracket attached to the base plate with the thermostat being mounted on the bracket in a position to be electrically connected between one end of the heating element and the electrical conductor otherwise connected to that end of the heating element.

* * * * *